US006890693B2

(12) United States Patent
Zhu et al.

(10) Patent No.: US 6,890,693 B2
(45) Date of Patent: May 10, 2005

(54) ORGANOPHOTORECEPTOR WITH AN ELECTRON TRANSPORT LAYER

(75) Inventors: Jiayi Zhu, Woodbury, MN (US); Nusrallah Jubran, St. Paul, MN (US); Zbigniew Tokarski, Woodbury, MN (US); James A. Baker, Hudson, WI (US); Ronald J. Moudry, Woodbury, MN (US)

(73) Assignee: Samsung Electronics Co., Ltd., Suwon (KR)

( * ) Notice: Subject to any disclaimer, the term of this patent is extended or adjusted under 35 U.S.C. 154(b) by 84 days.

(21) Appl. No.: 10/396,536

(22) Filed: Mar. 25, 2003

(65) Prior Publication Data

US 2003/0194626 A1 Oct. 16, 2003

Related U.S. Application Data

(60) Provisional application No. 60/372,294, filed on Apr. 12, 2002.

(51) Int. Cl.[7] ..... G03G 5/047

(52) U.S. Cl. ..... 430/58.45; 430/58.05; 430/59.4; 430/64; 430/66; 430/124; 399/162

(58) Field of Search ..... 430/58.45, 58.05, 430/59.4, 64, 66, 124, 58.35; 399/162

(56) References Cited

U.S. PATENT DOCUMENTS

| | | | | |
|---|---|---|---|---|
| 4,075,013 | A | 2/1978 | Ward et al. | |
| 4,121,981 | A | 10/1978 | Ward et al. | |
| 4,277,551 | A | 7/1981 | Sonnonstine et al. | |
| 4,562,132 | A * | 12/1985 | Ong et al. | 430/58.25 |
| 4,613,557 | A | 9/1986 | Foley et al. | |
| 4,687,722 | A | 8/1987 | Ogawa | |
| 4,701,396 | A | 10/1987 | Hung et al. | |
| 4,835,081 | A | 5/1989 | Ong et al. | |
| 4,855,201 | A | 8/1989 | Badesha et al. | |
| 4,869,984 | A | 9/1989 | Kung et al. | |
| 4,913,996 | A | 4/1990 | Kung et al. | |
| 4,997,737 | A | 3/1991 | Bugner et al. | |
| 5,017,645 | A | 5/1991 | Ong et al. | |
| 5,034,293 | A | 7/1991 | Rule et al. | |
| 5,039,585 | A | 8/1991 | Rule et al. | |
| 5,055,366 | A | 10/1991 | Yu et al. | |
| 5,221,591 | A | 6/1993 | Bugner et al. | |
| 5,236,797 | A | 8/1993 | Kung et al. | |
| 5,266,429 | A | 11/1993 | Sorriero et al. | |
| 5,272,032 | A | 12/1993 | Cowdery et al. | |
| 5,300,385 | A | 4/1994 | Detty et al. | |
| 5,328,789 | A | 7/1994 | Nakamori et al. | |
| 5,336,577 | A | 8/1994 | Spiewak et al. | |
| 5,468,583 | A | 11/1995 | Gruenbaum et al. | |
| 5,500,317 | A | 3/1996 | Detty et al. | |
| 5,516,610 | A | 5/1996 | Nguyen et al. | |
| 5,518,853 | A | 5/1996 | Nguyen et al. | |
| 5,942,359 | A | 8/1999 | Kinoshita et al. | |
| 5,942,362 | A | 8/1999 | Tadokoro et al. | |
| 6,027,845 | A | 2/2000 | Kinoshita et al. | |
| 6,030,735 | A | 2/2000 | Springett | |
| 6,066,426 | A | 5/2000 | Mott et al. | |
| 6,068,956 | A | 5/2000 | Namba et al. | |
| 6,074,792 | A | 6/2000 | Namba et al. | |
| 6,132,914 | A | 10/2000 | Shimada | |
| 6,153,344 | A | 11/2000 | Miyamoto et al. | |
| 6,180,305 | B1 | 1/2001 | Ackley et al. | |
| 6,194,106 | B1 | 2/2001 | Bretscher et al. | |
| 6,346,355 | B2 | 2/2002 | Sugai et al. | |
| 6,451,493 | B1 * | 9/2002 | Omokawa et al. | 430/56 |
| 6,495,300 | B1 * | 12/2002 | Qi et al. | 430/66 |
| 6,586,148 | B1 * | 7/2003 | Graham et al. | 430/58.65 |

FOREIGN PATENT DOCUMENTS

EP 1 102 126 A1 11/2000

OTHER PUBLICATIONS

Y. Mizuta, H. Okada, F. Sugai, Y. Watanabe, & M. Yokoyama, "*Development of Novel Electron Transport Material With High Performance Applied To Organic Photoconductor For Xerography*", *Journal of Imaging Science of Japan*, 2001, v. 40, No. 4, pp. 350–356.

* cited by examiner

*Primary Examiner*—John L Goodrow
(74) *Attorney, Agent, or Firm*—Patterson, Thuente, Skaar & Christensen, P.A.

(57) ABSTRACT

Improved organophotoreceptor have an electrically conductive substrate, a charge generation layer comprising a charge generation compound and optionally a charge transport compound, and an overcoat layer comprising an electron transport compound wherein the charge generation layer is between the overcoat layer and the electrically conductive substrate. The organophotoreceptor can optionally comprise a charge transport layer and/or other desired layers. The organophotoreceptors are useful in electrophotographic imaging apparatuses and corresponding processes.

29 Claims, 1 Drawing Sheet

ORGANOPHOTORECEPTOR WITH AN ELECTRON TRANSPORT LAYER

CROSS REFERENCE TO RELATED APPLICATIONS

This application claims priority to U.S. Provisional Patent Application Ser. No. 60/372,294, filed on Apr. 12, 2002, entitled "Single Layer Organophotoreceptor With A Novel Release Layer," incorporated herein by reference.

FIELD OF THE INVENTION

This invention relates to organophotoreceptors suitable for use in electrophotography and, more specifically, to organophotoreceptors having an overcoat layer comprising an electron transport compound.

BACKGROUND OF THE INVENTION

In electrophotography, an organophotoreceptor in the form of a plate, disk, sheet, belt, drum or the like having an electrically insulating photoconductive element on an electrically conductive substrate is imaged by first uniformly electrostatically charging the surface of the photoconductive layer, and then exposing the charged surface to a pattern of light. The light exposure selectively dissipates the charge in the illuminated areas, thereby forming a pattern of charged and uncharged areas. A liquid or solid toner is then deposited in either the charged or uncharged areas depending on the properties of the toner to create a toned image on the surface of the photoconductive layer. The resulting toned image can be transferred to a suitable receiving surface such as paper. The imaging process can be repeated many times to complete a single image and/or to reproduce additional images.

Both single layer and multilayer photoconductive elements have been used. In single layer embodiments, a charge transport material and charge generating material are combined with a polymeric binder and then deposited on the electrically conductive substrate. In multilayer embodiments, the charge transport material and charge generating material are in the form of separate layers, each of which can optionally be combined with a polymeric binder, deposited on the electrically conductive substrate. Two arrangements are possible. In one arrangement (the "dual layer" arrangement), the charge generating layer is deposited on the electrically conductive substrate and the charge transport layer is deposited on top of the charge generating layer. In an alternate arrangement (the "inverted dual layer" arrangement), the order of the charge transport layer and charge generating layer is reversed.

In both the single and multilayer photoconductive elements, the purpose of the charge generating material is to generate charge carriers (i.e., holes and/or electrons) upon exposure to light. The purpose of the charge transport composition is to accept holes, i.e., positive charge carriers, and to transport them through the charge transport layer in order to facilitate discharge of a surface charge on the photoconductive element.

As more advanced, higher speed electrophotographic systems such as copiers, duplicators, fax machines, and printers were developed, degradation of image quality was encountered during cycling. Moreover, complex, highly sophisticated electrophotographic systems operating at high speeds have placed stringent requirements including narrow operating limits on organophotoreceptors. For example, the numerous layers found in many modern organophotoreceptors must adhere well to adjacent layers, and exhibit predictable electrical characteristics within narrow operating limits to provide excellent toner images over many thousands of cycles.

SUMMARY OF THE INVENTION

In a first aspect, the invention features an organophotoreceptor that includes:

a) an electrically conductive substrate;

b) a charge generation layer comprising a charge generation compound; and c) an overcoat layer having an electron transport compound wherein said charge generation layer is between said overcoat layer and said electrically conductive substrate.

In a second aspect, the invention features an electrophotographic imaging apparatus that includes (a) a plurality of support rollers; and (b) the above-described organophotoreceptor. The organophotoreceptor can be operably coupled to the support rollers with motion of the support rollers resulting in motion of the organophotoreceptor. For example, the organophotoreceptor can be in the form of a flexible belt threaded around the support rollers. The apparatus can further include a toner dispenser.

In a third aspect, the invention features an electrophotographic imaging process that includes (a) applying an electrical charge to a surface of the above-described organophotoreceptor; (b) imagewise exposing the surface of the organophotoreceptor to radiation to dissipate charge in selected areas and thereby form a pattern of charged and uncharged areas on the surface; (c) contacting the surface with a toner to create a toned image; and (d) transferring the toned image to a substrate.

DETAILED DESCRIPTION OF PREFERRED EMBODIMENTS

Figure 1:
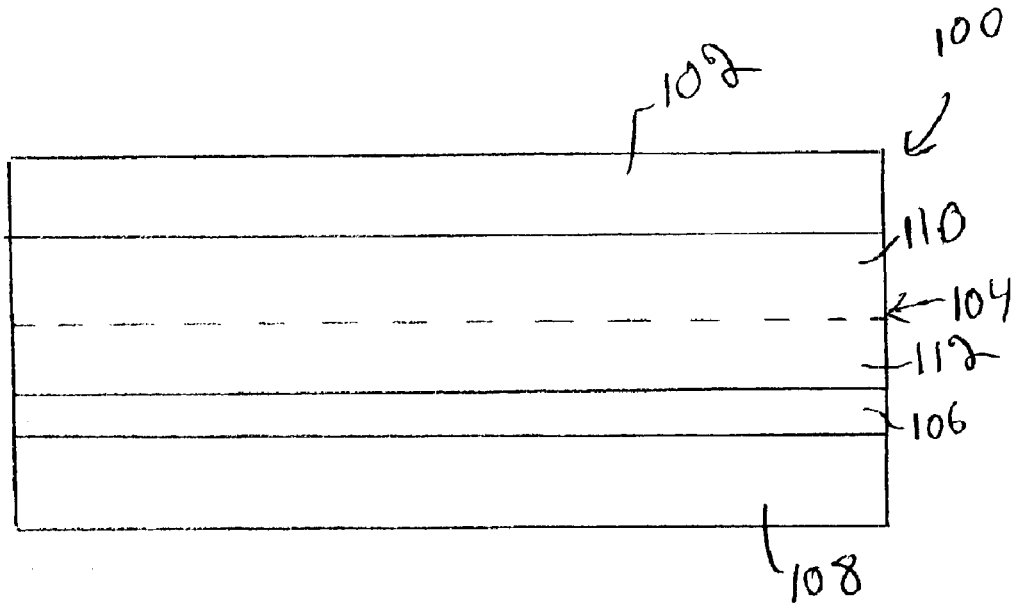
FIG. 1 is a schematic side view of an organophotoreceptor having an overcoat layer with an electron transport composition.

Improved organophotoreceptors comprise an overcoat layer on top of a charge generating layer (single layer or inverted dual layer) comprising at least a charge generating compound, in which the overcoat layer comprises an electron transport compound. In some embodiments, the overcoat layer can be applied as a release layer at the surface of the organophotoreceptor. The overcoat layer can be particularly suitable for electrophotographic imaging with a positive surface charge. This overcoat layer with at least one electron transport compound provides desirable charge transfer properties, good mechanical abrasion for cycling, and good chemical resistance to ozone, carrier fluid and contaminants.

Organophotoreceptors generally can comprise an overcoat layer that protects the underlying layers from mechanical degradations and attacks by chemicals such as carrier fluid, corona gases, and ozone. Generally, in order for an overcoat layer to provide the desired protection they should possess certain mechanical properties, and generally are applied in a substantially uniform thickness. Additionally, the overcoat material should be selected so as to not adversely affect the photoelectric properties of the organophotoreceptor.

The amount of charge that the charge transport composition can accept is indicated by a parameter known as the acceptance voltage or "$V_{acc}$", and the retention of that charge upon discharge is indicated by a parameter known as the discharge voltage or "$V_{dis}$". The overcoat layer generally should not have an uppermost surface having a high conductivity so that a high "$V_{acc}$" can be obtained and latent image spread (LIS) along the surface is appropriately low. However, the overcoat layers should not possess a high electrical resistivity to electrons from the layers below the overcoat layer, such as a charge generating layer (single layer or inverted dual layer) or to holes from a charge transport layer (dual layer), so that the overcoat layer does not have a high "$V_{dis}$" or trap charges opposite to the polarity of the photoconductor.

There are overcoat compositions described in the prior art. There continues to be a need in particular embodiments for additional organophotoreceptors with an overcoat layer that provides a high "$V_{acc}$", a low "$V_{dis}$", a good mechanical abrasion for cycling, and a good chemical resistance to ozone, carrier fluid and contaminants.

The organophotoreceptors described herein are particularly useful in laser printers and the like as well as photocopiers, scanners and other electronic devices based on electrophotography. The use of these organophotoreceptors is described in more detail below in the context of laser printer use, although their application in other devices operating by electrophotography can be generalized from the discussion below. To produce high quality images, particularly after multiple cycles, it is desirable for the electron transport composition to form a homogeneous solution with a polymeric binder for forming an overcoat layer and remain approximately homogeneously distributed through the overcoat layer during the cycling of the material.

In electrophotography applications, a charge generating compound within an organophotoreceptor absorbs light to form electron-hole pairs. These electron-hole pairs can be transported over an appropriate time frame under a large electric field to discharge locally a surface charge that is generating the field. The discharge of the field at a particular location results in a surface charge pattern that essentially matches the pattern drawn with the light. This charge pattern then can be used to guide toner deposition. The charge transport compositions described herein are especially effective at transporting charge, and in particular holes from the electron-hole pairs formed by the charge generating compound. In some embodiments, a specific electron transport compound can also be used along with the charge transport composition.

The layer or layers of materials containing the charge generating compound and the appropriate transport compositions are within an organophotoreceptor. To print a two dimensional image using the organophotoreceptor, the organophotoreceptor has a two dimensional surface for forming at least a portion of the image. The imaging process then continues by cycling the organophotoreceptor to complete the formation of the entire image and/or for the processing of subsequent images. The organophotoreceptor may be provided in the form of a plate, a flexible belt, a disk, a rigid drum, a sheet around a rigid or compliant drum, or the like. The organophotoreceptor may include an electrically conductive substrate and a photoconductive element featuring a charge generating layer.

The organophotoreceptor generally comprises a charge generating material that absorbs light to generate electron and hole pairs. The organophotoreceptor material may further comprise a charge transport compound that is effective for transporting holes, i.e., positive charge carriers. In some embodiments, the organophotoreceptor material has a single layer with both a charge transport composition and a charge generating compound within a polymeric binder. In further embodiments, a charge generating compound is in a charge transport layer distinct from the charge generating layer. For embodiments with the improved overcoats described herein, the charge transport layer generally is intermediate between the charge generating layer and the electrically conductive substrate. Alternatively, the charge generating layer may be intermediate between the charge transport layer and the electrically conductive substrate.

The organophotoreceptors can be incorporated into an electrophotographic imaging apparatus, such as laser printers. In these devices, an image is formed from physical embodiments and converted to a light image that is scanned onto the organophotoreceptor to form a surface latent image. The surface latent image can be used to attract toner onto the surface of the organophotoreceptor, in which the toner image is the same or the negative of the light image projected onto the organophotoreceptor. The toner can be a liquid toner or a dry toner. The toner is subsequently transferred, from the surface of the organophotoreceptor, to a receiving surface, such as a sheet of paper. After the transfer of the toner, the entire surface is discharged, and the material is ready to cycle again. The imaging apparatus can further comprise, for example, a plurality of support rollers for transporting a paper receiving medium and/or for movement of the photoreceptor, suitable optics to form the light image, a light source, such as a laser, a toner source and delivery system and an appropriate control system.

An electrophotographic imaging process generally can comprise (a) applying an electrical charge to a surface of the above-described organophotoreceptor; (b) imagewise exposing the surface of the organophotoreceptor to radiation to dissipate charge in selected areas and thereby form a pattern of charged and uncharged areas on the surface; (c) exposing the surface with a toner, such as a liquid toner that includes a dispersion of colorant particles in an organic liquid to create a toner image, to attract toner to the charged or discharged regions of the organophotoreceptor; and (d) transferring the toner image to a substrate.

Organophotoreceptors

The organophotoreceptor may be, for example, in the form of a plate, a flexible belt, a disk, a rigid drum, or a sheet around a rigid or compliant drum, with flexible belts and rigid drums generally being used in commercial embodiments. The organophotoreceptor may comprise, for example, an electrically conductive substrate and a photoconductive element in the form of one or more layers. The photoconductive element comprises a charge generating compound in a polymeric binder in the form of a charge generating layer. In the improved photoconductor elements described herein, an electron conducting layer with an electron conducting composition is located as an overcoat directly or indirectly on top of the layer with the, charge generating compound, i.e., away from the electrically conductive substrate. In some embodiments, the photoconductor element can comprise a plurality of overcoat layers with an electron conducting composition. The photoconductive layer can also comprise a charge transport composition, which may be in the same layer with the charge generating layer and/or in a separate layer. The organophotoreceptors with an overcoat comprising an electron transport composition can be particularly effective in electrophotography embodiments in which a positive charge layer is formed on the surface of the organophotoreceptors since facilitation of electron transport to the surface, for appropriately neutralizing surface positive charge in response to photoabsorption, can improve performance.

Referring to FIG. 1, organophotoreceptor 100 comprises overcoat layer 102, charge generating core 104, electrically conducting substrate 106 and an optional electrically insulating substrate 108. Organophotoreceptor 100 can further comprise other optional layers, some of which are described further below. Overcoat layer 102 can be a release layer, i.e., the upper most layer that releases toner to a receiving material.

Overcoat layer 102 can comprise an electron transport compound and a polymer. In particular, overcoat layer 102 can comprise the electron transport compound in an amount of from about 5 to about 50 weight percent and in some embodiments in an amount of from about 20 to about 40 weight percent, based on the weight of the overcoat layer. In some embodiments, overcoat layer 102 has an average thickness from about 0.5 microns to about 10 microns and in further embodiments from about 1 micron to about 3 microns. In some embodiments, the overcoat layer generally increases mechanical abrasion resistance, increases resistance to carrier liquid and atmospheric moisture, and decreases degradation of the photoreceptor by corona gasses.

Any suitable electron transport composition may be used in overcoat layer 102. Generally, the electron transport composition has an electron affinity that is large relative to potential electron traps while yielding an appropriate electron mobility in a composite with a polymer. In some embodiments, the electron transport composition has a reduction potential less than $O_2$. In general, electron transport compositions are easy to reduce and difficult to oxidize while charge transport compositions generally are easy to oxidize and difficult to reduce. In some embodiments, the electron transport compounds have a room temperature, zero field electron mobility of at least about $1\times10^{-13}$ $cm^2/Vs$, in further embodiments at least about $1\times10^{-10}$ $cm^2/Vs$, in additional embodiments at least about $1\times10^{-8}$ $cm^2/Vs$, and in other embodiments at least about $1\times10^{-6}$ $cm^2/Vs$. A person of ordinary skill in the art will recognize that other ranges of electron mobility within the explicit ranges are contemplated and are within the present disclosure.

Non-limiting examples of suitable electron transport compound include bromoanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-indeno4H-indeno[1,2-b]thiophene-4-one, and 1,3,7-trinitrodibenzothiophene-5,5-dioxide, (2,3-diphenyl-1-indenylidene)malononitrile, 4H-thiopyran-1,1-dioxide and its derivatives, such as 4-dicyanomethylene-2,6-diphenyl-4H-thiopyran-1,1-dioxide, 4-dicyanomethylene-2,6-di-m-tolyl-4H-thiopyran-1,1-dioxide, and unsymmetrically substituted 2,6-diaryl-4H-thiopyran-1,1-dioxide such as 4H-1,1-dioxo-2-(p-isopropyl phenyl)-6-phenyl-4-(dicyanomethylidene)thiopyran and 4H-1,1-dioxo-2-(p-isopropyl phenyl)-6-(2-thienyl)-4-(dicyanomethyl-idene)thiopyran, derivatives of phospha-2,5-cyclohexadiene, alkoxycarbonyl-9-fluorenylidene) malononitrile derivatives such as (4-n-butoxycarbonyl-9-fluorenylidene)malononitrile, (4-phenethoxycarbonyl-9-fluorenylidene) malononitrile, (4-carbitoxy-9-fluorenylidene)malononitrile, and diethyl(4-n-butoxy carbonyl-2,7-dinitro-9-fluorenylidene)-malonate, anthraquinodimethane derivatives such as 11,11,12,12-tetracyano-2-alkylanthraquinodimethane and 11,11-dicyano-12,12-bis(ethoxycarbonyl)anthraquinodimethane, anthrone derivatives such as 1-chloro-10-[bis (ethoxycarbonyl) methylene] anthrone, 1,8-dichloro-10-[bis (ethoxycarbonyl) methylene]anthrone, 1,8-dihydroxy-10-[bis(ethoxycarbonyl)methylene]anthrone, and 1-cyano-10-[bis(ethoxycarbonyl) methylene) anthrone, 7-nitro-2-aza-9-fluroenylidene-malononitrile, diphenoquinone derivatives, benzoquinone derivatives, naphtoquinone derivatives, quinine derivatives, tetracyanoethylenecyanoethylene, 2,4,8-trinitro thioxantone, dinitrobenzene derivatives, dinitroanthracene derivatives, dinitroacridine derivatives, nitroanthraquinone derivatives, dinitroanthraquinone derivatives, succinic anhydride, maleic anhydride, dibromo maleic anhydride, pyrene derivatives, carbazole derivatives, hydrazone derivatives, N,N-dialkylaniline derivatives, diphenylamine derivatives, triphenylamine derivatives, triphenylmethane derivatives, tetracyanoquinone dimethane, 2,4,5,7-tetranitro-9-fluorenone, 5 2,4,7-trinitro-9-dicyanomethylenene fluorenone, 2,4,5,7-tetranitroxanthone derivatives, and 2,4,8-trinitrothioxanthone derivatives.

In describing chemicals by structural formulae and group definitions, certain terms are used in a nomenclature format that is chemically acceptable. The terms groups, moiety, and derivatives have defined meanings. The term group indicates that the generically recited chemical material (e.g., alkyl group, phenyl group, fluorenylidene malonitrile group, carbazole hydrazone group, etc.) may have any substituent thereon which is consistent with the bond structure of that group. For example, alkyl group includes alkyl materials such as methyl ethyl, propyl iso-octyl, dodecyl and the like, and also includes such substituted alkyls such as chloromethyl, dibromoethyl, 1,3-dicyanopropyl, 1,3,5-trihydroxyhexyl, 1,3,5-trifluorocyclohexyl, 1-methoxydodecyl, phenylpropyl and the like. However, as is consistent with such nomenclature, no substitution would be included within the term that would alter the fundamental bond structure of the underlying group. For example, where a phenyl ring group is recited, substitution such as 1-hydroxyphenyl, 2,4-fluorophenyl, orthocyanophenyl, 1,3,5-trimethoxyphenyl and the like would be acceptable within the terminology, while substitution of 1,1,2,2,3,3-hexamethylphenyl would not be acceptable as that substitution would require the ring bond structure of the phenyl group to be altered to a non-aromatic form because of the substitution. Where the term moiety is used, such as alkyl moiety or phenyl moiety, that terminology indicates that the chemical material is not substituted. Where the term derivative is used, that terminology indicates that a compound is derived or obtained from another and containing essential elements of the parent substance.

The polymer in overcoat layer 102 generally is capable of dispersing or dissolving the electron transport composition. Examples of suitable polymer binders generally include, for example, polystyrene-co-butadiene, polystyrene-co-acrylonitrile, modified acrylic polymers, polyvinyl acetate, styrene-alkyd resins, soya-alkyl resins, polyvinylchloride, polyvinylidene chloride, polyacrylonitrile, polycarbonates, polyacrylic acid, polyacrylates, polymethacrylates, styrene polymers, polyvinyl butyral, alkyd resins, polyamides, polyurethanes, polyesters, polysulfones, polyethers, polyketones, phenoxy resins, epoxy resins, silicone resins, polysiloxanes, poly(hydroxyether) resins, polyhydroxystyrene resins, novolak, poly(phenylglycidyl ether)-co-dicyclopentadiene, copolymers of monomers used in the above-mentioned polymers, and combinations thereof. In some embodiments of particular interest, the binder is selected from the group consisting of polycarbonates, polyvinyl butyral, and a combination thereof. Examples of suitable polycarbonate binders include polycarbonate A which is derived from bisphenol-A, polycarbonate Z, which is derived from cyclohexylidene bisphenol, polycarbonate C, which is derived from methylbisphenol A, and polyestercarbonates. Examples of suitable of polyvinyl butyral are BX-1 and BX-5 form Sekisui Chemical Co. Ltd., Japan. In embodiments in which overcoat layer is a release layer, it may be desirable for the polymer to be, for example, a fluorinated polymer, siloxane polymer, fluorosilicone polymer, polysilane, polyethylene, polypropylene, polyacrylate, poly(methyl methacrylate-co-methacrylic acid), urethane resins, urethane-epoxy resins, acrylated-urethane resins, urethane-acrylic resins, crosslinked polymers thereof or a combination thereof.

Charge generating core 104 can comprise a charge generation layer 110 and optionally a charge transport layer 112. For embodiments in which charge generation core 104 comprises a single layer construction, charge generation layer 110 generally comprises a charge transport compound and a charge generating compound within a single layer. In embodiments in which charge generating core 104 comprises a bilayer construction featuring charge generation layer 110 with a charge generating compound and charge transport layer 112 with a charge transport compound, the charge transport layer 112 may be located intermediate between the electrically conductive substrate 106 and charge generation layer 110 to facilitate transport of holes to electrically conductive substrate 106. Alternatively, the photoconductive element may have a structure in which the charge generation layer 110 is intermediate between the electrically conductive substrate 106 and the charge transport layer 112. An electron transport composition can be present in charge generation layer 110 and/or charge transport layer 112.

The photoconductive layer overall typically has a thickness of from about 10 to about 45 microns. In the dual layer embodiments, charge generation layer 110 generally has a thickness form about 0.5 to about 2 microns, and the charge transport layer has a thickness from about 5 to about 35 microns. In a single layer embodiment, the layer with the charge generating compound and the charge transport composition generally has a thickness from about 7 to about 30 microns. A person of ordinary skill in the art will recognize that additional ranges of thickness within the explicit ranges above are contemplated and are within the present disclosure.

For the dual layer embodiments of charge generating core 104, charge generation layer 110 generally comprises a binder in an amount from about 10 to about 90 weight percent and in some embodiments in an amount of from about 20 to about 75 weight percent, based on the weight of the charge generation layer. Charge transport layer 112 generally comprises a binder in an amount from about 30 weight percent to about 70 weight percent. A person of ordinary skill in the art will recognize that additional ranges of binder concentrations for the dual layer embodiments within the explicit ranges above are contemplated and are within the present disclosure.

For the single layer embodiments of charge generating core 104, the photoconductive layer generally comprises a binder, a charge transport compound and a charge generation compound. The charge generation compound is in an amount of from about 1 to about 25 weight percent and in further embodiment in an amount of from about 2 to about 15 weight percent, based on the weight of the photoconductive layer. The charge transport compound is in an amount of from about 25 to about 65 weight percent, based on the weight of the photoconductive layer, and in further embodiments in an amount of from about 30 to about 55 weight percent, based on the weight of the photoconductive layer, with the remainder of the photoconductive layer comprising the binder, and optionally additive, such as any conventional additives. A single layer with a charge transport composition and a charge generating compound generally comprises a binder in an amount from about 10 weight percent to about 75 weight percent, and in further embodiments from about 25 weight percent to about 60 weight percent. Optionally, the photoconductive layer of this invention may comprise an electron transport compound. The electron transport compound in the photoconductive layer, if present, generally can be in an amount of from about 5 to about 30 weight percent and more preferably in an amount of from about 10 to about 25 weight percent, based on the weight of the photoconductive layer. A person of ordinary skill in the art will recognize that additional compositions ranges within the explicit compositions ranges for the layers above are contemplated and are within the present disclosure.

The binder generally is capable of dispersing or dissolving the charge transport composition (in the case of the charge transport layer or a single layer construction) and/or the charge generating compound (in the case of the charge generating layer or a single layer construction). Examples of suitable binders for both the charge generating layer and charge transport layer include, for example, the polymer binders described above with respect to overcoat layer 102.

The charge generating compound is a material, such as a dye or pigment, which is capable of absorbing light to generate charge carriers. Examples of suitable charge generating compounds include metal-free phthalocyanines (e.g., CGM-X01 available from Sanyo Color Works, Ltd.), metal phthalocyanines such as titanium phthalocyanine, copper phthalocyanine, oxytitanium phthalocyanine, hydroxygallium phthalocyanine, squarylium dyes and pigments, hydroxy-substituted squarylium pigments, perylimides, polynuclear quinones available from Allied Chemical Corporation under the trade name INDOFAST ® Double Scarlet INDOFAST® Violet Lake B, INDOFAST® Brilliant Scarlet and INDOFAST® Orange, quinacridones available from DuPont under the trade name MONASTRAL™ Red, MONASTRAL™ Violet and MONASTRAL™ Red Y, naphthalene 1,4,5,8-tetracarboxylic acid derived pigments including the perinones, tetrabenzoporphyrins and tetranaphthaloporphyrins, indigo- and thioindigo dyes, benzothioxanthene-derivatives, perylene 3,4,9,10-tetracarboxylic acid derived pigments, polyazo-pigments including bisazo-, trisazo- and tetrakisazo-pigments, polymethine dyes, dyes containing quinazoline groups, tertiary amines, amorphous selenium, selenium alloys such as selenium-tellurium, selenium-tellurium-arsenic and selenium-arsenic, cadmium sulphoselenide, cadmium selenide, cadmium sulphide, and mixtures thereof. For some embodiments, the charge generating compound comprises oxytitanium phthalocyanine, hydroxygallium phthalocyanine or a combination thereof.

There are many kinds of charge transport compounds available for electrophotography. For example, any charge transport compound known in the art can be used to form organophotoconductors described herein. Suitable charge transport compounds include, but are not limited to, pyrazoline derivatives, fluorene derivatives, oxadiazole derivatives, stilbene derivatives, hydrazone derivatives, carbazole hydrazone derivatives, triaryl amines, polyvinyl carbazole, polyvinyl pyrene, polyacenaphthylene, or multi-hydrazone compounds comprising at least two hydrazone groups and at least two groups selected from the group consisting of triphenylamine and heterocycles such as carbazole, julolidine, phenothiazine, phenazine, phenoxazine, phenoxathiin, thiazole, oxazole, isoxazole, dibenzo(1,4)dioxine, thianthrene, imidazole, benzothiazole, benzotriazole, benzoxazole, benzimidazole, quinoline, isoquinoline, quinoxaline, indole, indazole, pyrrole, purine, pyridine, pyridazine, pyrimidine, pyrazine, triazole, oxadiazole, tetrazole, thiadiazole, benzisoxazole, benzisothiazole, dibenzofuran, dibenzothiophene, thiophene, thianaphthene, quinazoline, or cinnoline.

Electrically conductive substrate 106, along with electrically insulating substrate 108, may be flexible, for example in the form of a flexible web or a belt, or inflexible, for example in the form of a drum. A drum can have a hollow cylindrical structure that provides for attachment of the drum to a drive that rotates the drum during the imaging process. Typically, the combined substrate comprises an electrically insulating substrate and a thin layer of electrically conductive material as the electrically conductive substrate onto which the photoconductive material is applied.

The electrically insulating substrate may be paper or a film forming polymer such as polyethylene terephthalate, polyimide, polysulfone, polyethylene naphthalate, polypropylene, nylon, polyester, polycarbonate, polyvinyl fluoride, polystyrene, mixtures thereof and the like. Specific examples of polymers for supporting substrates included for example, polyethersulfone (STABAR™ S-100, available from ICI), polyvinyl fluoride (TEDLAR®, available from E.I. DuPont de Nemours & Company), polybisphenol-A polycarbonate (MACROFOL™, available from Mobay Chemical Company) and amorphous polyethylene terephthalate (MELINAR™, available from ICI Americas, Inc.). the electrically conductive materials may be graphite, dispersed carbon black, iodide, conductive polymers such as polypyroles and Calgon conductive polymer 261 (commercially available from Calgon Corporation, Inc., Pittsburgh, Pa.), metals such as aluminum, titanium, chromium, brass, gold, copper, palladium, nickel, or stainless steel, or metal oxide such as tin oxide or indium oxide. In embodiments of particular interest, the electrically conductive material is aluminum. Generally, the photoconductor substrate has a thickness adequate to provide the required mechanical stability. For example, flexible web. substrates generally have a thickness from about 0.01 to about 1 mm, while drum substrates generally have a thickness of from about 0.5 mm to about 2 mm.

The photoreceptor may optionally have additional layers as well. Such additional layers can be, for example, a sub-layer and/or an additional overcoat layer. The sub-layer can be a charge blocking layer and locates between the electrically conductive substrate and the photoconductive element. The sub-layer may also improve the adhesion between the electrically conductive substrate and the photoconductive element.

With respect to additional overcoat layers, the photoreceptor can comprise a plurality of overcoat layers having an electron transport composition, such as overcoat layer 102. While an overcoat layer in addition to layer 102 may or may not have an electron transport composition, the presence of an electron transport composition in each overcoat layer (which may or may not be the same composition as in other overcoat layers) provides continuity of electrical conductivity between the charge generating layer and the surface, which may improve the performance of the organophotoreceptor. Overcoat layers generally can be, for example, a barrier layer, a release layer, and/or an adhesive layer. A release layer forms the uppermost layer of the photoconductor element. A barrier layer may be sandwiched between a release layer and the charge generating layer. The barrier layer provides protection for abrasion and solvent resistance to the underlayers. An adhesive layer locates and improves the adhesion between a charge generating layer and an overcoat layer or between two overcoat layers.

Suitable barrier layers include, for example, coatings such as crosslinkable siloxanol-colloidal silica coating and hydroxylated silsesquioxane-colloidal silica coating, and organic binders such as polyvinyl alcohol, methyl vinyl ether/maleic anhydride copolymer, casein, polyvinyl pyrrolidone, polyacrylic acid, gelatin, starch, polyurethanes, polyimides, polyesters, polyamides, polyvinyl acetate, polyvinyl chloride, polyvinylidene chloride, polycarbonates, polyvinyl butyral, polyvinyl acetoacetal, polyvinyl formal, polyacrylonitrile, polymethyl methacrylate, polyacrylates, polyvinyl carbazoles, copolymers of monomers used in the above-mentioned polymers, vinyl chloride/vinyl acetate/vinyl alcohol terpolymers, vinyl chloride/vinyl acetate/maleic acid terpolymers, ethylene/vinyl acetate copolymers, vinyl chloride/vinylidene chloride copolymers, cellulose polymers, and mixtures thereof. The above barrier layer polymers optionally may contain small inorganic particles such as fumed silica, silica, titania, alumina, zirconia, or a combination thereof. Barrier layers are described further in U.S. Pat. No. 6,001,522 to Woo et at., entitled Barrier Layer For Photoconductor Elements Comprising An Organic Polymer And Silica," incorporated herein by reference.

The release layer topcoat may comprise, for example, any release layer composition known in the art. In some embodiments, the release layer is a fluorinated polymer, siloxane polymer, fluorosilicone polymer, polysilane, polyethylene, polypropylene, polyacrylate, poly(methyl methacrylate-co-methacrylic acid), urethane resins, urethane-epoxy resins, acrylated-urethane resins, urethane-acrylic resins, or a combination thereof. The release layers can comprise crosslinked polymers.

Generally, adhesive layers comprise a film forming polymer, such as polyester, polyvinylbutyral, polyvinylpyrolidone, polyurethane, polymethyl methacrylate, poly(hydroxy amino ether) and the like. Overcoat layers are described further in U.S. Pat. No. 6,180,305 to Ackley et al., entitled "Organic Photoreceptors For Liquid Electrophotography," incorporated herein by reference.

Sub-layers can comprise, for example, polyvinylbutyral, organosilanes, hydrolyzable silanes, epoxy resins, polyesters, polyamides, polyurethanes, silicones and the like. In some embodiments, the sub-layer has a dry thickness between about 20 Angstroms and about 2,000 Angstroms. Sublayers containing metal oxide conductive particles can be 1–25 microns thick.

The organophotoreceptors as described herein are suitable for use in an imaging process with either dry or liquid toner development including, for example, dry toners and liquid toners known in the art. Liquid toner development can be desirable because it offers the advantages of providing higher resolution images and requiring lower energy for image fixing compared to dry toners. Examples of suitable liquid toners are known in the art. Liquid toners generally comprise toner particles dispersed in a carrier liquid. The toner particles generally can comprise a colorant/pigment, a resin binder, and/or a charge director. In some embodiments of liquid toner, a resin to pigment ratio can be from 2:1 to 10:1, and in other embodiments, from 4:1 to 8:1. Liquid toners are described further in Published U.S. Patent Application Nos. 2002/0128349, entitled "Liquid Inks Comprising A Stable Organosol," 2002/0086916, entitled "Liquid Inks Comprising Treated Colorant Particles," and 2002/0197552, entitled "Phase Change Developer For Liquid Electrophotography," all three of which are incorporated herein by reference.

Organophotoreceptor (OPR) Preparation Methods

Conveniently, the charge generating core layer may be formed by dispersing or dissolving, into one or more coating solutions, a charge generating compound, a charge transport compound, optionally an electron transport compound, and a polymeric binder in organic solvent, coating the dispersion and/or solution on the respective underlying layer in one or more layers and drying the coating. The overcoat with the electron transport composition is similarly coated. Any additional layers can be applied as appropriate in the desired order. The coatings can be applied, for example, using knife coating, extrusion, dip coating or other appropriate coating approaches, including those known in the art. Some specific examples are presented below.

The invention will now be described further by way of the following examples.

EXAMPLES

Example 1

Preparation of (4-n-Butoxycarbonyl-9-Fluorenylidene) Malononitrile

This example describes the synthesis of a charge transport composition, specifically (4-n-butoxycarbonyl-9-fluorenylidene)malononitrile.

A 460 g quantity of concentrated sulfuric acid (4.7 moles, analytical grade, commercially obtained from Sigma-Aldrich, Milwaukee, Wis.) and 100 g of diphenic acid (0.41 mole, commercially obtained from Acros Fisher Scientific Company Inc., Hanover Park, IL) were added to a 1-liter 3-neck round bottom flask, equipped with thermometer, mechanical stirrer and reflux condenser. Using a heating mantle, the flask was heated to 135–145° C. for 12 minutes, and then cooled to room temperature. After cooled to room temperature, the solution was added to a 4 liter Erlenmeyer containing 3 liter of water. The mixture was stirred mechanically and was boiled gently for one hour. A yellow solid was filtered out hot, washed with hot water until the pH of the washing water was neutral. The solid was dried in the air overnight. The yellow solid was fluorenone-4-carboxylic acid (75 g, 80% yield) with a melting point of 223–224° C. A $^1$H-NMR spectrum of fluorenone-4-carboxylic acid was obtained in $d_6$-DMSO with a 300 MHz NMR from Bruker Instrument. The peaks were found at δ=7.39–7.50 (m, 2H); δ=7.79–7.70 (q, 2H); δ=7.74–7.85 (d, 1H); δ=7.88–8.00 (d, 1H ); and δ=8.18–8.30 (d, 1H), where d is doublet, t is triplet, m is multiplet; dd is double doublet, q is quintet.

A 70 g (0.312 mole) quantity of fluorenone-4-carboxylic acid produced as described above along with 480 g (6.5 mole) of n-Butanol (commercially obtained from Fisher Scientific Company Inc., Hanover Park, Ill.), 1000 ml of Toluene and 4 ml of concentrated sulfuric acid were added to a 2-liter round bottom flask equipped with a mechanical stirrer and a reflux condenser with a Dean Stark apparatus. The solution was refluxed for 5 hours with aggressive agitation and refluxing, during which about 6 g of water were collected in the Dean Stark apparatus. Then, the flask was cooled to room temperature. The solvents were evaporated, and the residue was added to 4-liter of 3% sodium bicarbonate aqueous solution with agitation. The solid was filtered off, washed with water until the pH of the water was neutral, and dried in the hood overnight. The product was n-butyl fluorenone-4-carboxylate ester (70 g, 80% yield). A $^1$H-NMR spectrum of n-butyl fluorenone-4-carboxylate ester was obtained in $CDCl_3$ by a 300 MHz NMR from Bruker Instrument. The peaks were found at δ=0.87–1.09 (t, 3H); δ=1.42–1.70 (m, 2H); δ=1.75–1.88 (q, 2H); δ=4.26–4.64 (t, 2H); δ=7.29–7.45 (m, 2H);δ=7.46–7.58 (m, 1H); δ=7.60–7.68 (dd, 1H); δ=7.75–7.82 (dd, 1H); δ=7.90–8.00 (dd, 1H); δ=8.25–8.35 (dd, 1H).

A 70 g (0.25 mole) quantity of n-butyl fluorenone-4-carboxylate ester produced as described above along with 750 ml of absolute methanol, 37 g (0.55 mole) of malononitrile (commercially obtained from Sigma-Aldrich, Milwaukee, Wis.), 20 drops of piperidine (commercially obtained from Sigma-Aldrich, Milwaukee, Wis.) were added to a 2-liter, 3-neck round bottom flask equipped with a mechanical stirrer and a reflux condenser. The solution was refluxed for 8 hours, and then the flask was cooled to room temperature. The orange crude product was filtered, washed twice with 70 ml of methanol and once with 150 ml of water, and dried in the hood for overnight. This orange crude product was recrystallized from a mixture of 600 ml of acetone and 300 ml of methanol using activated charcoal. The flask was placed at 0° C. for 16 hours. The crystals were filtered and dried in a vacuum oven at 50° C. for 6 hours to obtain 60 g of pure (4-n-butoxycarbonyl-9-fluorenylidene) malononitrile. The melting point was 99–100° C. A $^1$H-NMR spectrum of (4-n-butoxycarbonyl-9-fluorenylidene) malononitrile was obtained in $CDCl_3$ by a 300 MHz NMR from Bruker Instrument. The peaks were found at δ=0.74–1.16 (t, 3H); δ=1.38–1.72 (m, 2H); δ=1.70–1.90 (q, 2H); δ=4.29–4.55 (t, 2H); δ=7.31–7.43 (m, 2H); δ=7.45–7.58 (m, 1H); δ=7.81–7.91 (dd, 1H); δ=8.15–8.25 (dd, 1H); δ=8.42–8.52 (dd, 1H ); δ=8.56–8.66 (dd, 1H).

Example 2

Formation Of Organophotorecptors

Comparative Sample A

The sample of Comparative Sample A is a positive single layer OPC coated on a substrate that consists of a 76-micron (3-mil) aluminized polyester substrate (Melinex 442 polyester film having a 1 ohm/square aluminum vapor coat, commercially obtained from Dupont) and a 0.3-micron polyester resin sub-layer (Vitel PE-2200, commercially obtained from Bostik, Middletown, Mass.). The coating solution for the single layer OPC was prepared by pre-mix a solution containing 0.25 g of (4-n-butoxycarbonyl-9-fluorenylidene) malononitrile, 1.05 g of an enamine-stylbene type of charge transfer compound (MPCT-10, commercially obtained from Mitsubishi Paper Mills, Tokyo, Japan), 1.40 g of polycarbonate-Z200 (commercially obtained from Mitsubishi Engineering-Plastics Corporation, White Plains, N.Y.), 4.86 g of 1,4-dioxane (commercially obtained from Aldrich, Milwaukee, Wis.), and 3.24 g of tetrahydrofuran (commercially obtained from Aldrich, Milwaukee, Wis.). A 1.4 g quantity of a CGM mill-base was then added to the coating solution.

The CGM mill-base was formed from 9.3% by weight of oxytitanium phthalocyanine pigment (commercially obtained from H. W. Sands Corp., Jupiter, Fla.), 4.6% by weight of polycarbonate-Z200, and 86% by weight of 1,4-dioxane (commercially obtained from Aldrich, Milwaukee, Wis.) that was sand-milled with 1-micron zirconium beads on a horizontal sand mill (model LMC12 DCMS, commercially obtained from Netzsch Incorporated, Exton, Pa.) for 10 hours.

After mixing the coating solution on a mechanical shaker for about 30 minutes, a single layer of coating solution was coated onto the substrate described above using a knife coater with a gap space of 87 micron followed by drying in an oven at 110° C. for 10 minutes. The thickness of the resulting dried single layer OPC coating was about 10 micron.

Comparative Sample B

The sample of Comparative Sample B was prepared with an overcoat layer formed with a copolymer of poly(methyl methacrylate-co-methacrylic acid) having about 75% by weight of poly(methacrylic acid) (M-14-vv-170, commercially obtained from Orgsteklo, Russia) that was crosslinked with 25% by weight of 1,4-butanediol diglycidyl ether (commercially obtained from Aldrich, Milwaukee, Wis.). The overcoat solution was prepared by first dissolving 4.5 g of the copolymer in a mixture of 42.75 g of ethanol and 42.75 g of de-ionized water to form a copolymer solution. Then, in a separate container, 2.5 g of the crosslinker in a mixture of 23.75 g of ethanol and 23.75 g of de-ionized water was dissolved to form a crosslinker solution. Finally, a 30.0 g quantity of the crosslinker solution was added to the copolymer solution. The overcoat layer of the crosslinked copolymer was then made by spreading the copolymer solution using a knife coater with 40 micron of gap space onto a sample formed as described in Comparative Example A followed by drying in an oven at 110° C. for 20 min.

Comparative Sample C

The sample of Comparative Sample C is similar to the Comparative Example B, except that the overcoat layer of crosslinked copolymer was coated onto a single layer organophotoconductor with a different composition. The organic photoconductor was prepared from a solution that was prepared by premixing-a solution containing 4.55 g of a charge transfer compound 1,10-bis[3-(methylphenyl hydazonyl-9-carbazolyl)decane (the synthesis of which is described in U.S. Pat. No. 6,066,426 to Mott et al., entitled "Organophotoreceptors For Electrophotography Featuring Novel Charge Transport Compounds," incorporated herein by reference), 4.55 g of polycarbonate-Z200, 8.19 g of 1,4-dioxane, 16.38 g of tetrahydrofuran, and 2.73 g of methyl ethyl ketone. A 7.1 quantity of a CGM mill-base was then added to the pre-mix to form the coating solution. The CGM mill-base contained 7% by weight of oxytitanium phthalocyanine pigmenti 3% by weight of polycarbonate-Z-200, and 90% by weight of 1,4-dioxane (commercially obtained from Aldrich, Milwaukee, Wis.) that was milled with 14 mm glass beads on a ball-mill tumbler for 36 hours. A coating of the single layer organic photoconductor was prepared the same way as described in Comparative Sample A while coating of the overcoat layer for Comparative Sample C was prepared the same way as described in Comparative Sample B.

Sample 1

Sample 1 was prepared with an overcoat solution formulated by adding 25% by weight of total solids in solution of (4-n-butoxycarbonyl-9-fluorenylidene) malononitrile into the crosslinked copolymer described in Comparative Sample B. The overcoat solution was prepared by first dissolving 4.5 g of (4-n-butoxycarbonyl-9-fluorenylidene) malononitrile in 50 g of acetone. Then, 25 g of this freshly prepared solution was added to 75 g of the crosslinked copolymer solution described in Comparative Sample B. The resulting overcoat solution was coated onto a sample as described in Comparative Sample A by following the same procedure described in Comparative Sample B.

Sample 2

Sample 2 was prepared with an overcoat solution formulated by adding 9% by weight of total solids in solution of (4-n-butoxycarbonyl-9-fluorenylidene) malononitrile into the crosslinked copolymer described in Comparative Sample B. The overcoat solution was prepared by first dissolving 4.5 g of (4-n-butoxycarbonyl-9-fluorenylidene) malononitrile in 50 g of acetone. Then, 1 g of this freshly prepared solution was added to 10 g of the crosslinked copolymer solution described in Comparative Sample B. The resulting overcoat solution was coated onto a sample as described in Comparative Sample C by following the same procedure described in Comparative Sample B.

Sample 3

Sample 3 was prepared similarly as described in Example 2, except that the overcoat solution was formulated by adding 23% by weight of total solids in solution of (4-n-butoxycarbonyl-9-fluorenylidene) malononitrile into the crosslinked copolymer described in Comparative Sample B. Specifically, the overcoat solution was prepared by first dissolving 4.5 g of (4-n-butoxycarbonyl-9-fluorenylidene) malononitrile in 50 g of acetone. Then, 3 g of this freshly prepared solution was added to 10 g of the crosslinked copolymer solution described in Comparative Sample B. The coating was formed as described in Sample 2.

Sample 4

Sample 4 was prepared similarly as described in Sample 2, except that the overcoat solution was formulated by adding 33% by weight of total solids in solution of (4-n-butoxycarbonyl-9-fluorenylidene) malononitrile into the crosslinked copolymer described in Comparative Sample B. Specifically, the overcoat solution was prepared by first dissolving 4.5 g of (4-n-butoxycarbonyl-9-fluorenylidene) malononitrile in 50 g of acetone. Then, 5 g of this freshly prepared solution was added to 10 g of the crosslinked copolymer solution described in Comparative Sample B. The coating was formed as described in Sample 2.

Sample 5

Sample 5 was prepared similarly as described in Sample 2, except that the overcoat solution was formulated by adding 41% by weight of total solids in solution of (4-n-butoxycarbonyl-9-fluorenylidene) malononitrile into the crosslinked copolymer described in Comparative Sample B. Specifically, the overcoat solution was prepared by first dissolving 4.5 g of (4-n-butoxycarbonyl-9-fluorenylidene) malononitrile in 50 g of acetone. Then, 7 g of this freshly prepared solution was added to 10 g of the crosslinked copolymer solution described in Comparative Sample B. The coating was formed as described in Sample 2.

Sample 6

Sample 6 was prepared similarly as described in Sample 2, except that the overcoat solution was formulated by adding 50% by weight of total solids in solution of (4-n-butoxycarbonyl-9-fluorenylidene) malononitrile into the crosslinked copolymer described in Comparative Sample B. Specifically, the overcoat solution was prepared by first dissolving 4.5 g of (4-n-butoxycarbonyl-9-fluorenylidene) malononitrile in 50 g of acetone. Then, 10 g of this freshly prepared solution was added to 10 g of the crosslinked copolymer solution described in Comparative Sample B. The coating was formed as described in Sample 2.

Example 3

Electrostatic Testing And Properties Of Organophotoreceptors

This example provides results of electrostatic testing on the organophotoreceptors formed as described in Example 2.

Electrostatic cycling performance of organophotoreceptors comprising the overcoat layers described herein can be determined using in-house designed and developed test bed that is capable of testing, for example, the hand coated sample strips wrapped around a 160 mm drum. The results on these samples are indicative of results that would be obtained with other support structures, such as belts, drums and the like, for supporting the organophotoreceptors.

For testing using a 160 mm drum, three coated sample strips, each measuring 50 cm long by 8.8 cm wide, are fastened side-by-side and completely around an aluminum drum (50.3 cm circumference). In some embodiments, at least one of the strips is a comparative example that is precision web coated and used as an internal reference point. In this electrostatic cycling tester, the drum rotated at a rate of 8.13 cm /sec (3.2 ips), and the location of each station in the tester (distance and elapsed time per cycle) is given as shown in the following table:

TABLE 1

Electrostatic test stations around the 160 mm drum at 8.13 cm/sec.

| Station | Degrees | Total Distance, cm | Total Time, sec |
|---|---|---|---|
| Front erase bar edge | 0° | Initial, 0 cm | Initial, 0 s |
| Erase Bar | 0–7.2° | 0–1.0 | 0–0.12 |
| Scorotron Charger | 113.1–135.3° | 15.8–18.9 | 1.94–2.33 |
| Laser Strike | 161.0° | 22.5 | 2.77 |
| Probe #1 | 181.1° | 25.3 | 3.11 |
| Probe #2 | 251.2° | 35.1 | 4.32 |
| Erase bar | 360° | 50.3 | 6.19 |

The erase bar is an array of laser emitting diodes (LED) with a wavelength of 720 nm. that discharges the surface of the organophotoreceptor. The scorotron charger comprises a wire that permits the transfer of a desired amount of charge to the surface of the organophotoreceptor.

From the above table, the first electrostatic probe (Trek 344 electrostatic meter, Trek, Inc. Medina, N.Y.) is located 0.34 s after the laser strike station and 0.78 s after the scorotron while the second probe (Trek 344 electrostatic meter) is located 1.21 s from the first probe and 1.99 s from the scorotron. All measurements are performed at ambient temperature and relative humidity.

Electrostatic measurements were obtained as a compilation of several runs on a test station with the 160 mm, drum. The first three diagnostic tests (prodtest initial, VlogE initial, dark decay initial) are designed to evaluate the electrostatic cycling of a new, fresh sample and the last three, identical diagnostic test (prodtest final, VlogE final, dark decay final) are run after cycling of the sample. In addition, measurements were made periodically during the test, as described under "longrun" below. The laser is operated at 780 nm wavelength, 600 dpi, 50 micron spot size, 60 nanoseconds/pixel expose time, 1,800 lines per second scan speed, and a 100% duty cycle. The duty cycle is the percent exposure of the pixel clock period, i.e., the laser is on for the full 60 nanoseconds per pixel at a 100% duty cycle.

Electrostatic Test Suite:

1) PRODTEST: Charge acceptance ($V_{acc}$) and discharge voltage ($V_{dis}$) were established by subjecting the samples to corona charging (erase bar always on) for three complete drum revolutions (laser off); discharged with the laser @ 780 nm & 600 dpi on the forth revolution (50 um spot size, expose 60 nanoseconds/pixel, run at a scan speed of 1,800 lines per second, and use a 100% duty cycle); completely charged for the next three revolutions (laser off); discharged with only the erase lamp @ 720 nm on the eighth revolution (corona and laser off) to obtain residual voltage ($V_{res}$); and, finally, completely charged for the last three revolutions (laser off). The contrast voltage ($V_{con}$) is the difference between $V_{acc}$ and $V_{dis}$ and the functional dark decay ($V_{dd}$) is the difference in charge acceptance potential measured by probes #1 and #2.

2) VLOGE: This test measures the photoinduced discharge of the photoconductor to various laser intensity levels by monitoring the discharge voltage of the sample as a function of the laser power (exposure duration of 50 ns) with fixed exposure times and constant initial potentials. This test measures the photoinduced discharge of the photoconductor to various laser intensity levels by monitoring the discharge voltage of the sample as a function of the laser power (exposure duration of 50 ns) with fixed exposure times and constant initial potentials. The functional photosensitivity, $S_{780nm}$, was determined from this diagnostic test.

3) DARK DECAY: This test measures the loss of charge acceptance in the dark with time without laser or erase illumination for 90 seconds and can be used as an indicator of i) the injection of residual holes from the charge generation layer to the charge transport layer, ii) the thermal liberation of trapped charges, and iii) the injection of charge from the surface or aluminum ground plane.

4) LONGRUN: The sample was electrostatically cycled for 100 to 1,000 drum revolutions according to the following sequence per each sample-drum revolution. The sample was charged by the corona, the laser was cycled on and off (80–100° sections) to discharge a portion of the sample and, finally, the erase lamp discharged the whole sample in preparation for the next cycle. The laser was cycled so that the first section of the sample was never exposed, the second section was always exposed, the third section was never exposed, and the final section was always exposed. This pattern was repeated for a total of 100 to 1,000 drum revolutions, and the data was recorded periodically, after every 5th cycle for the 100 cycle longrun or after every 50th cycle for the 1,000 cycle longrun.

5) After the LONGRUN test, the PRODTEST, VLOGE, DARK DECAY diagnostic tests were run again.

The following Table shows the results from the prodtest initial and prodtest final diagnostic tests. The values for the charge acceptance voltage (Vacc, probe #1 average voltage obtained from the third cycle), discharge voltage (Vdis, probe #1 average voltage obtained from the fourth cycle), functional dark decay voltage (Vdd, average voltage difference between probes 1 & 2 obtained from the third cycle), and the residual voltage (Vres, probe 1, average voltage obtained from the eighth cycle) are reported for the initial and final cycles.

TABLE 2

Electrostatic Results after 100 and 1000 cycles

| | | Prodtest Initial | | | | | Prodtest Final | | | | | Changes after cycling | | |
|---|---|---|---|---|---|---|---|---|---|---|---|---|---|---|
| Samples | # of cycles | Vacc | Vdis | Cont | Vdd | Vres | Vacc | Vdis | Cont | Vdd | Vres | $\Delta V_{acc}$ | ΔVdis | ΔVres |
| Comparative Sample-A | 100 | 555 | 91 | 464 | 73 | 40 | 570 | 126 | 444 | 65 | 52 | 15 | 35 | 12 |
| Comparative Sample-B | 100 | 568 | 215 | 353 | 69 | 107 | 575 | 264 | 311 | 70 | 120 | 7 | 49 | 13 |
| Sample-1 | 100 | 584 | 123 | 461 | 73 | 65 | 597 | 160 | 437 | 73 | 73 | 13 | 37 | 8 |
| Comparative Sample C | 100 | 634 | 382 | 252 | 65 | 245 | 669 | 387 | 282 | 48 | 250 | 35 | 5 | 5 |
| Sample-2 | 100 | 636 | 272 | 364 | 62 | 180 | 665 | 266 | 399 | 41 | 172 | 29 | −6 | −8 |
| Sample-3 | 100 | 623 | 284 | 339 | 54 | 196 | 663 | 282 | 381 | 38 | 192 | 40 | −2 | −4 |
| Sample-4 | 100 | 646 | 206 | 440 | 35 | 122 | 600 | 220 | 380 | 51 | 135 | −46 | 14 | 13 |
| Sample-5 | 100 | 651 | 162 | 489 | 30 | 83 | 589 | 177 | 412 | 53 | 98 | −62 | 15 | 15 |
| Sample-6 | 100 | 617 | 170 | 447 | 28 | 87 | 615 | 186 | 429 | 36 | 102 | −2 | 16 | 15 |
| Comparative Sample-A | 1000 | 586 | 93 | 493 | 71 | 49 | 407 | 116 | 291 | 81 | 66 | −179 | 23 | 17 |
| Sample-1 | 1000 | 576 | 127 | 449 | 63 | 67 | 561 | 165 | 396 | 64 | 84 | −15 | 38 | 17 |

Note:
1) Vacc and Vdis are charge acceptance voltage and discharge voltage, respectively.
2) Cont is the contrast voltage and is the difference between the charge acceptance voltage and the discharge voltage ($V_{acc} - V_{dis}$).
3) ΔVacc, ΔVdis, and ΔVres are differences for charge acceptance, discharge, and residual voltages at the start and end of the cycling (100 cycles or 1,000 cycles).

These results demonstrate that all of the samples performed adequately and some of the samples performed very well.

The embodiments above are intended to be illustrative and not limiting. Additional embodiments are within the claims. Although the present invention has been described with reference to particular embodiments, workers skilled in the art will recognize that changes may be made in form and detail without departing from the spirit and scope of the invention.

What is claimed is:

1. An organophotoreceptor comprising:

a) an electrically conductive substrate;

b) a single layer photoconductive element comprising a charge generation compound, a charge transport compound, and a first electron transport compound; and c) an overcoat layer comprising a second electron transport compound wherein said charge generation layer is between said overcoat layer and said electrically conductive substrate.

2. An organophotoreceptor according to claim 1 wherein said charge transport compound comprises a carbazole hydrazone group.

3. An organophotoreceptor according to claim 1 wherein said second electron transport compound comprises a fluorenylidene malonitrile group.

4. An organophotoreceptor according to claim 1 wherein said overcoat layer further comprises a polymeric binder.

5. An organophotoreceptor according to claim 1 wherein said overcoat layer comprises between about 5% and about 50% by weight of said second electron transport compound.

6. An organophotoreceptor according to claim 1 wherein said charge generation compound comprises a metal phthalocyanine.

7. An organophotoreceptor according to claim 1 wherein said single layer photoconductive element further comprises a polymeric binder.

8. An organophotoreceptor according to claim 1 further comprising a sublayer located between said electrically conductive substrate and said single layer photoconductive element.

9. An organophotoreceptor according to claim 1 further comprising a barrier layer located between said overcoat layer and said single layer photoconductive element.

10. An organophotoreceptor according to claim 1 further comprising a charge transport layer comprising a second charge transport compound.

11. An organophotoreceptor according to claim 10 wherein the charge transport layer is between the electrically conductive substrate and the charge generation layer.

12. An organophotoreceptor according to claim 1 wherein the overcoat layer has a thickness from about 0.5 microns to about 10 microns.

13. The organophotoreceptor according to claim 1 further comprising a release layer wherein the overcoat layer is between the release layer and the single layer photoconductive element.

14. An organophotoreceptor according to claim 1 wherein the overcoat layer is the top layer of the organophotoreceptor.

15. An electrophotographic imaging apparatus comprising:

(a) a plurality of support rollers; and (b) an organophotoreceptor operably coupled to said support rollers with motion of said support rollers resulting in motion of said organophotoreceptor, said organophotoreceptor comprising an electrically conductive substrate, a single layer photoconductive element comprising a charge generation compound, a charge transport compound, and a first electron transport compound, and an overcoat layer comprising a second electron transport compound wherein said single layer photoconductive element is between said overcoat layer and said electrically conductive substrate.

16. An electrophotographic imaging apparatus according to claim 15 wherein said organophotoreceptor is in the form of a flexible belt threaded around said support rollers.

17. An electrophotographic imaging apparatus according to claim 15 wherein said overcoat layer further comprises a third electron transport compound.

18. An electrophotographic imaging apparatus according to claim 15 wherein said overcoat layer further comprises a polymeric binder.

19. An electrophotographic imaging apparatus according to claim 15 wherein the amount of said second electron transport compound in said overcoat layer is between 5% and 50% by weight.

20. An electrophotographic imaging apparatus according to claim 15 wherein said second electron transport compound comprises a fluorenylidene malonitrile group.

21. An electrophotographic imaging apparatus according to claim 15 wherein said single layer photoconductive element further comprises a polymeric binder.

22. An electrophotographic imaging apparatus according to claim 15 further comprising a toner dispenser.

23. An electrophotographic imaging process comprising:

(a) applying an electrical charge to a surface of an organophotoreceptor comprising an electrically conductive substrate, a single layer photoconductive element comprising a charge generation compound, a charge transport compound, and a first electron transport compound, and an overcoat layer comprising a second electron transport compound wherein said single layer photoconductive element is between said overcoat layer and said electrically conductive substrate;

(b) imagewise exposing said surface of said organophotoreceptor to radiation to dissipate charge in selected areas and thereby form a pattern of charged and uncharged areas on said surface;

(c) contacting said surface with a toner to create a toned image; and (d) transferring said toned image to a substrate.

24. An electrophotographic imaging process according to claim 23 wherein said organophotoreceptor further comprises a charge transport layer comprising a charge transport compound wherein the charge transport layer is between the single layer photoconductive element and the electrically conductive substrate.

25. An electrophotographic imaging process according to claim 23 wherein said overcoat layer further comprises a third electron transport compound.

26. An electrophotographic imaging process according to claim 23 wherein said overcoat layer further comprises a polymeric binder.

27. An electrophotographic imaging process according to claim 23 wherein the amount of said second electron transport compound in said overcoat layer is between 5% and 50% by weight.

28. An electrophotographic imaging process according to claim 23 wherein said second electron transport compound comprises a fluorenylidene malonitrile group.

29. An electrophotographic imaging process according to claim 23 wherein said single layer photoconductive element further comprises a polymeric binder.

* * * * *